US005617582A

United States Patent [19]

Burwell

[11] Patent Number: 5,617,582

[45] Date of Patent: Apr. 8, 1997

[54] LOAD BEARING VEST

[76] Inventor: Daniel G. Burwell, 113 W. Twelve Oaks Rd., Raeford, N.C. 28376

[21] Appl. No.: 668,672

[22] Filed: Jun. 25, 1996

[51] Int. Cl.[6] ..... A41D 1/04; A41B 1/22

[52] U.S. Cl. ..... 2/102; 2/119; 2/94; 2/95; 2/920

[58] Field of Search ..... 2/102, 2.5, 247, 2/119, 94, 95, 920, 912

[56] References Cited

U.S. PATENT DOCUMENTS

| | | | |
|---|---|---|---|
| 1,623,993 | 4/1927 | Anderson | 2/102 |
| 1,656,145 | 1/1928 | Davis | 2/102 |
| 3,997,982 | 12/1976 | Holland | 2/119 |
| 4,106,121 | 8/1978 | Belson | 2/102 |
| 4,637,075 | 1/1987 | Ingrisano | 2/102 |
| 4,825,471 | 5/1989 | Jennings | 2/247 |
| 5,077,838 | 1/1992 | Senser | 2/94 |
| 5,465,425 | 11/1995 | Crispin | 2/102 |

*Primary Examiner*—Bibhu Mohanty
*Attorney, Agent, or Firm*—Dykema Gossett PLLC

[57] ABSTRACT

A load bearing vest for use by military and police personnel includes a right front panel, a left front panel and a rear panel, each being formed of a durable, abrasion resistant material. Right and left shoulder straps, also formed of durable abrasion resistant material, connect an upper portion of the rear panel with upper portions of the right front panel and left front panel respectively. Expandable right and left side panels formed of elastic material with a high strain capacity, connect the rear panel with the right front panel and the left front panel respectively below the shoulder strap to define right and left arm openings respectively therebetween. The side panels extend downward to the end of the front and rear panels. An expandable front closure connects the right front panel with the left front panel. A floating center panel is connected to the front closure in such a manner that the front closure remains elastically expandable independent of the floating panel.

8 Claims, 9 Drawing Sheets

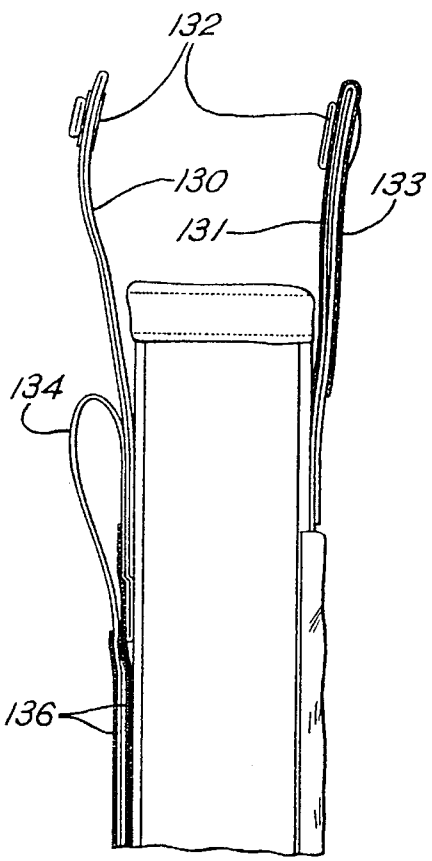
FIG.18B
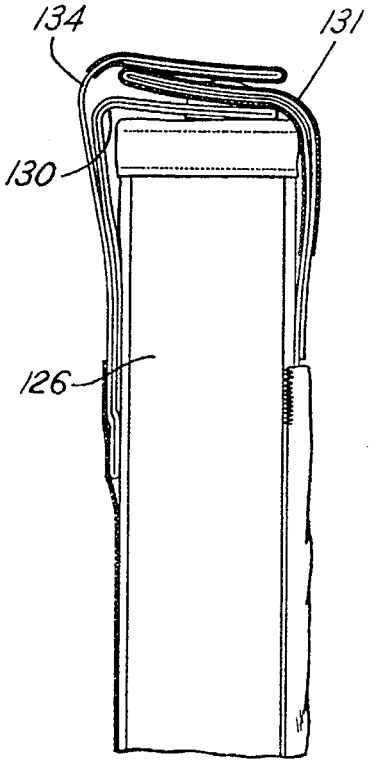
FIG.18A
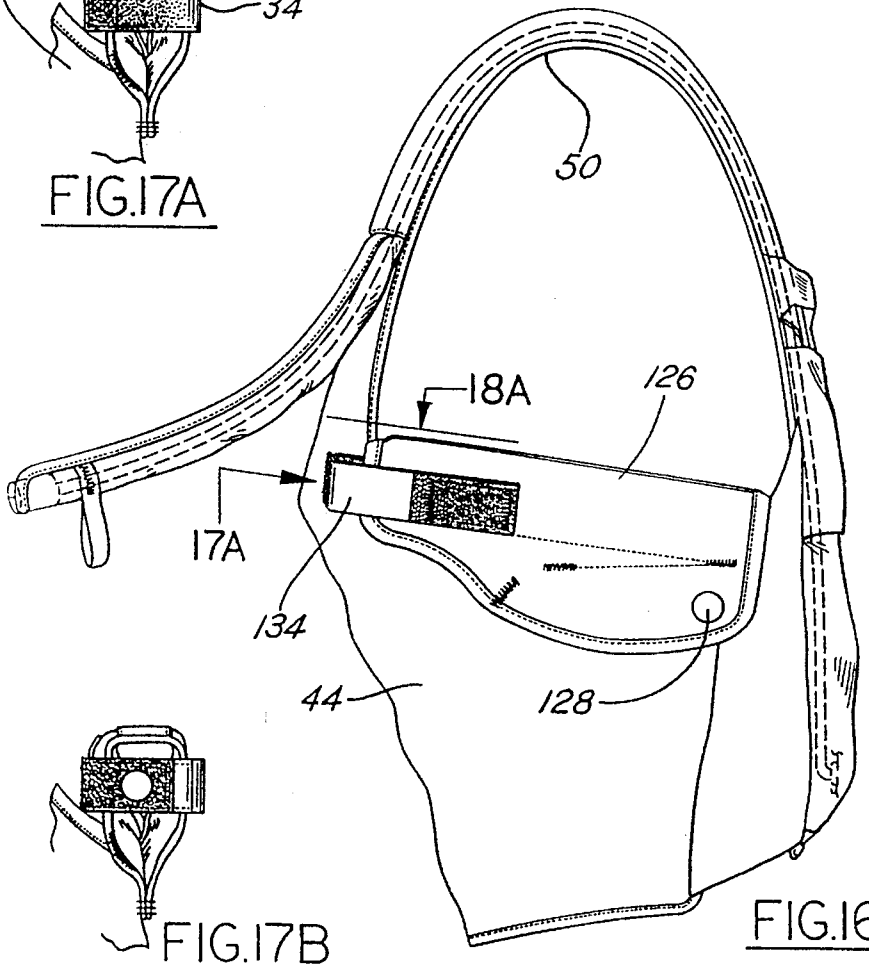
FIG.16
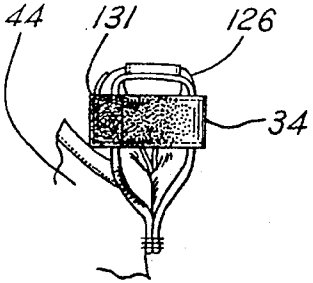
FIG.17A
FIG.17B

LOAD BEARING VEST

FIELD OF THE INVENTION

The present invention relates to load bearing vests, and more particularly to load bearing vests employed for military and police usages.

BACKGROUND OF THE INVENTION

Known load bearing vests designed for use by military and police personnel are time consuming to don, in that they must be laced up on at least one side after the wearer has positioned it on himself. Further, known vests have a tendency to move or slide around on the wearer even after it has been properly adjusted. An additional concern is that flaps over vest pockets used to retain the contents of the pockets make it difficult to access the contents of the pockets. Also, an inadequate number of pouches are typically provided for bullet clips and bullet magazines for the variety of weapons in use by the wearer. Further, drinking features, when provided, are generally located inconveniently.

It is desired to provide a load bearing vest overcoming the above shortcomings of known vests.

SUMMARY OF THE INVENTION

A load bearing vest for use by military and police personnel includes a right front panel, a left front panel and a rear panel, each being formed of a durable, abrasion resistant material. Right and left shoulder straps, also formed of durable abrasion resistant material, connect an upper portion of the rear panel with upper portions of the right front panel and left front panel respectively. Expandable right and left side panels formed of elastic material with a high strain capacity, connect the rear panel with the right front panel and the left front panel respectively below the shoulder strap to define right and left arm openings respectively therebetween. The side panels extend downward to the end of the front and rear panels. An expandable front closure connects the right front panel with the left front panel. A floating center panel is connected to the front closure in such a manner that the front closure remains elastically expandable independent of the floating panel.

The vest can also be configured to include a mesh material interior lining which resists slipping relative to other garments. The vest can also include one or more pouches having flaps which are biased upwards by elastic cords.

BRIEF DESCRIPTION OF THE DRAWINGS

FIG. 16 is a side view of a broken out portion of the vest, showing a holster and a drinking tube.

FIG. 17A is an end view of the holster of FIG. 16 taken in the direction of arrow 17A with both primary and secondary closure straps closed.

FIG. 17B is an end view in the direction of arrow 17A showing the snap closure engaged and a hook/pile closure open.

FIG. 18A is a side view of the holster of FIG. 16 shown in the direction of arrow 18A with both the primary and secondary closure flaps engaged.

FIG. 18B is a side view of the holster of FIG. 16 in the direction of arrow 18A showing both the primary and secondary holster closures in an open position.

DETAILED DESCRIPTION OF A PREFERRED EMBODIMENT

Figure 10:
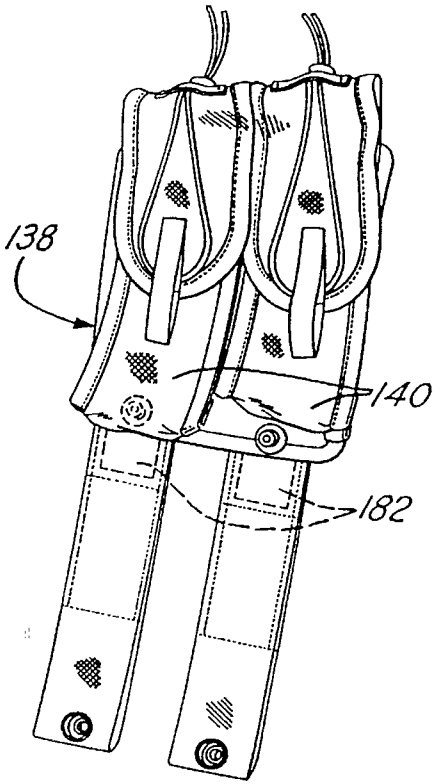
FIG. 10 is a front view of the auxilliary pouch assembly.
Figure 1:
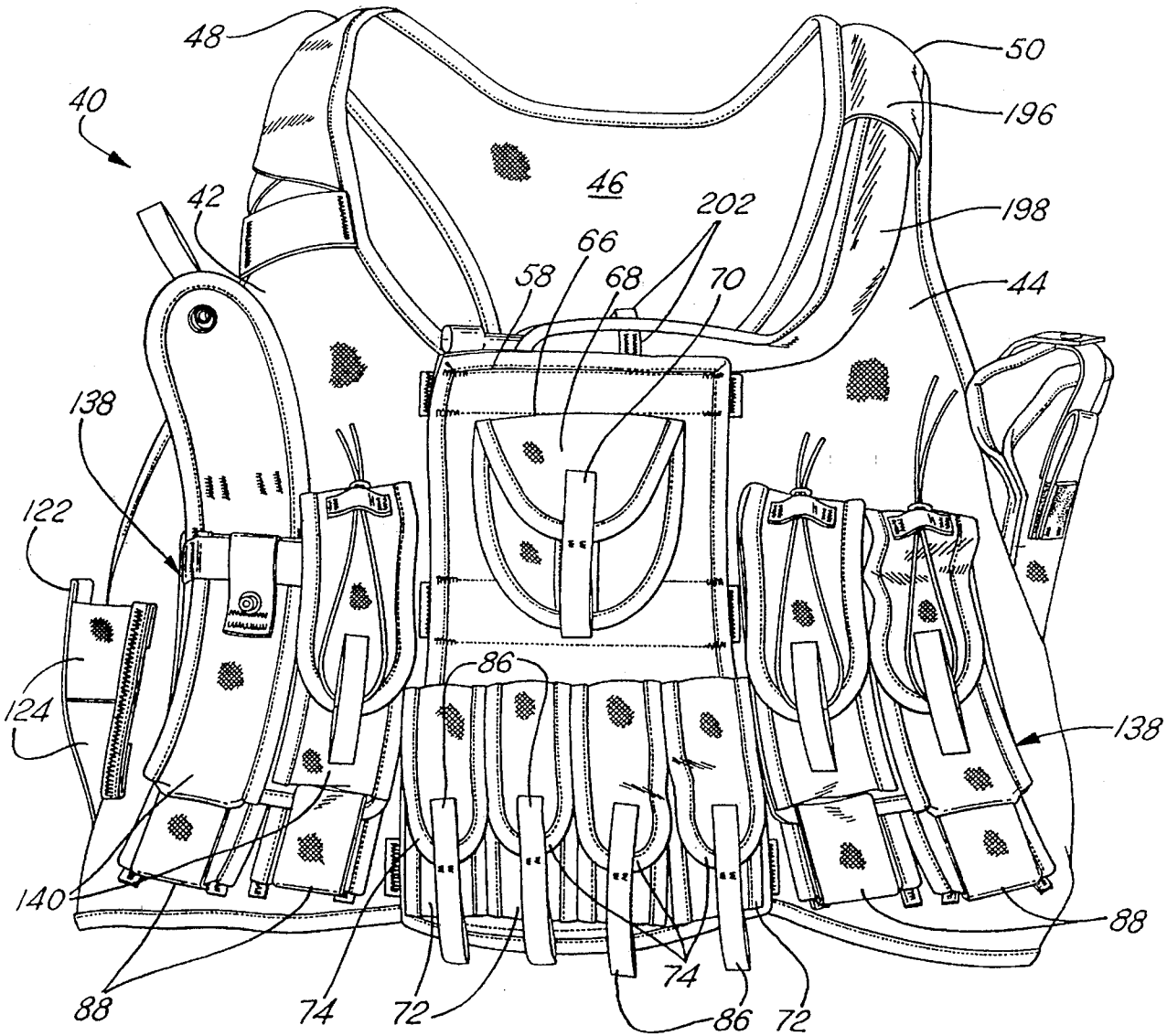
FIG. 1 is a front view of the vest.
Figure 2:
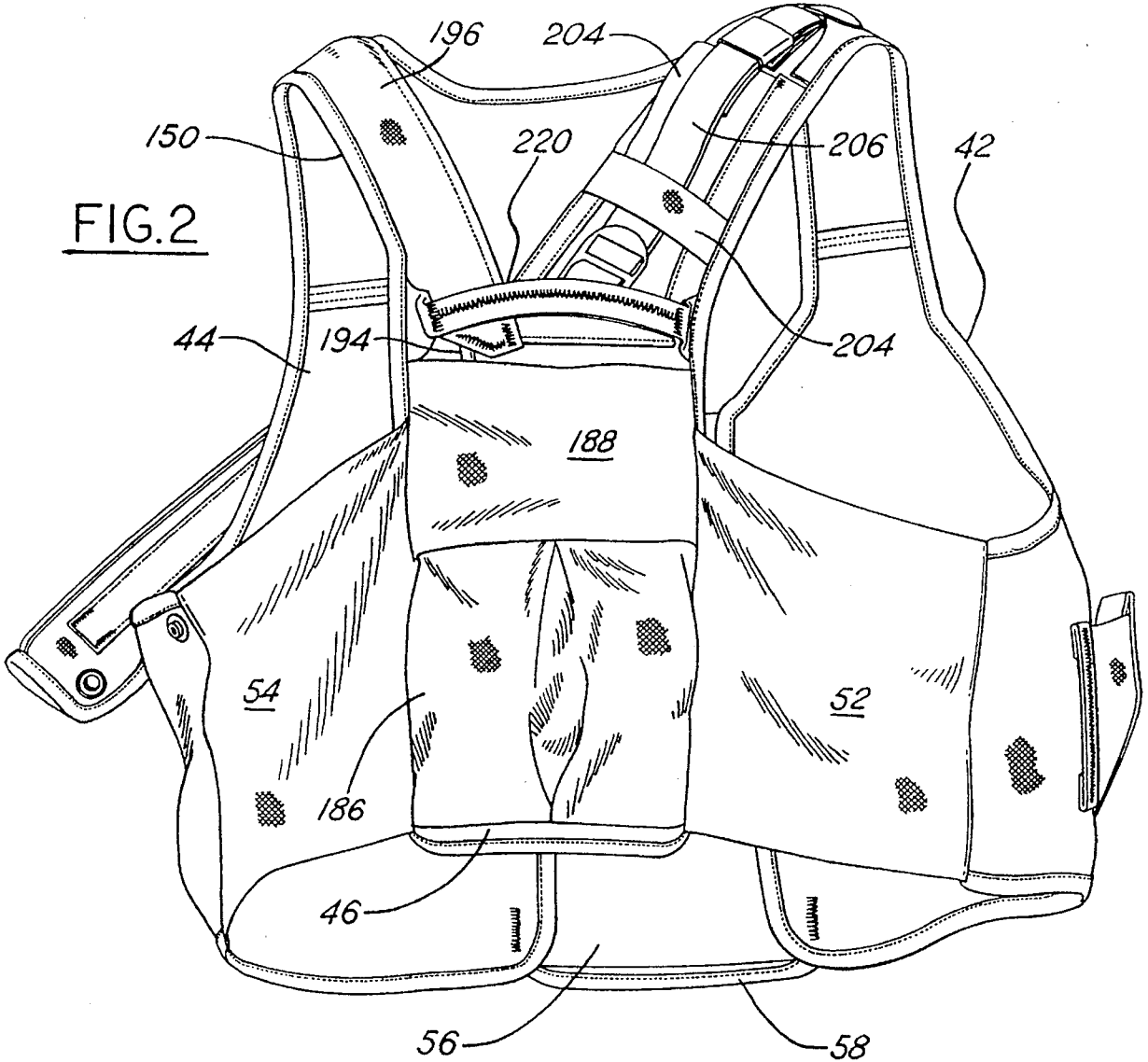
FIG. 2 is a rear view of the vest in a relaxed or unloaded position.
Figure 6:
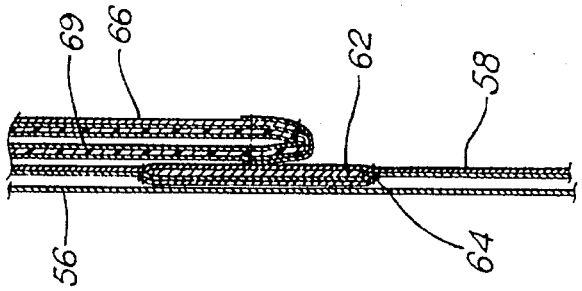
FIG. 6 is a sectional view of the front of the vest taken in the direction of arrows 6 of FIG. 5.

FIGS. 1 and 2 show the front and rear sides respectively of a load bearing vest for use by military or police personnel. The basic structure of the load bearing vest 40 includes a right front panel 42, a left front panel 44, and a rear panel 46, all cut from a heavy weight woven nylon material which is durable and abrasion resistant. A right shoulder strap 48 and a left shoulder strap 50 are formed integrally with the rear panel 46 of the same material as part of the same cutting, and are connected to upper portions of right front panel 42 and left front panel 44 respectively.

Figure 3:
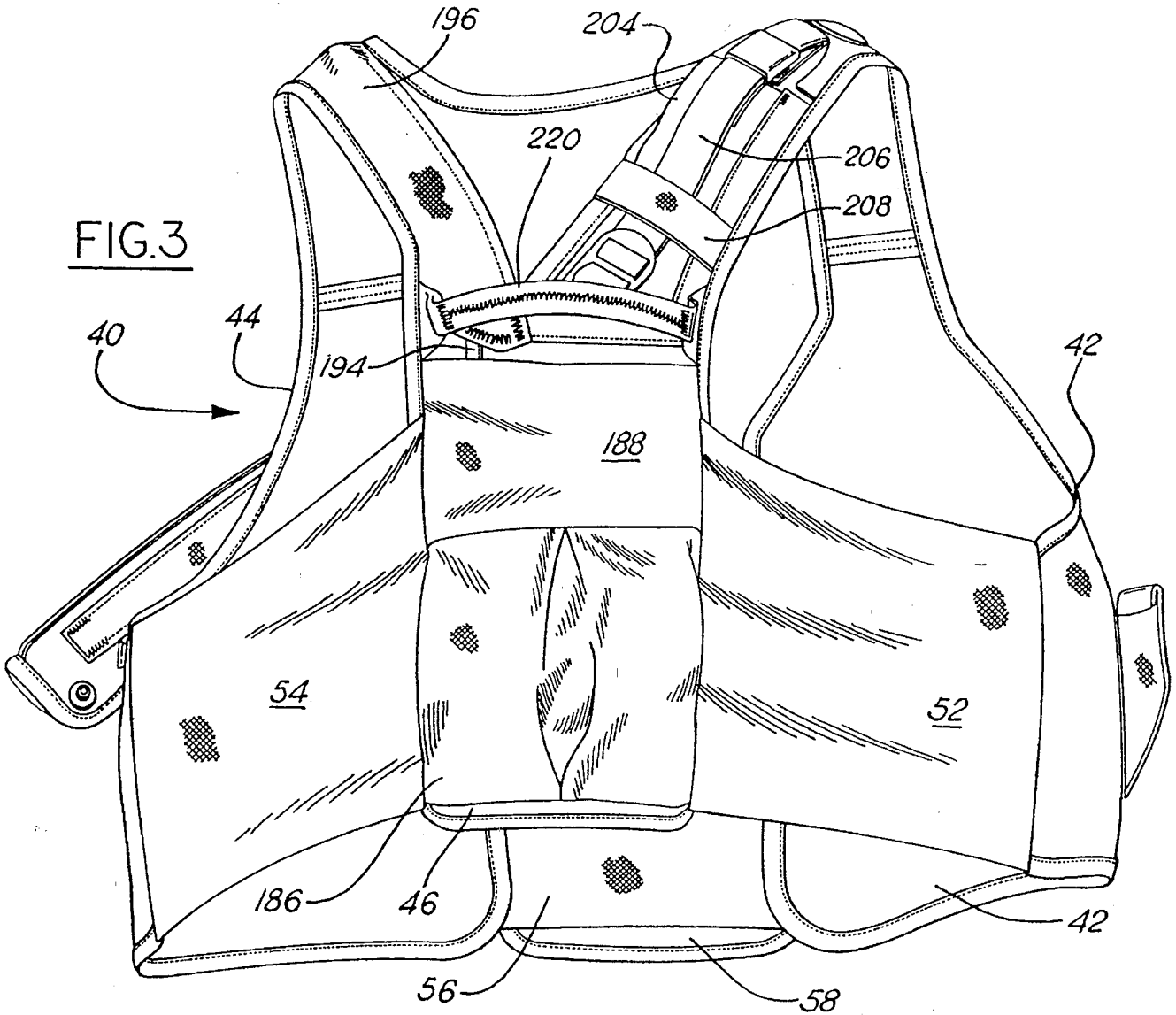
FIG. 3 is a rear view of the vest with the side panels and front center panel stretched.

A right side panel 52, best shown in FIG. 2, is formed of two layers of a woven, elastically expandable "Power Mesh" material. The Power Mesh material has a high strain capacity, making it able to stretch to approximately 150% of its free or unstrained width. Right side panel 52 connects right front panel 42 with a right side of rear panel 46. A left side panel 54, formed of the same material as right side panel 52, is similarly disposed between left front panel 44 and a left side of rear panel 46. The side panels 52 and 54 as shown in FIG. 2 are in a static or relaxed condition. FIG. 3 shows side panels 52 and 54 stretched or expanded.

An elastically expandable front center panel 56, formed of two layers of the same material as the side panels 52 and 54, is disposed between and connects right front panel 42 and left front panel 44. Front center panel 56 is in a relaxed condition in FIG. 4 and a stretched condition in FIG. 5.

A single layer of the elastically expandable Power Mesh material is disposed inside right front panel 42, left front panel 44, rear panel 46, right shoulder strap 48, and left shoulder strap 50 as an inner lining 60 of the vest. Substantially the entire interior of the vest is lined with the Power Mesh material.

Figure 4:
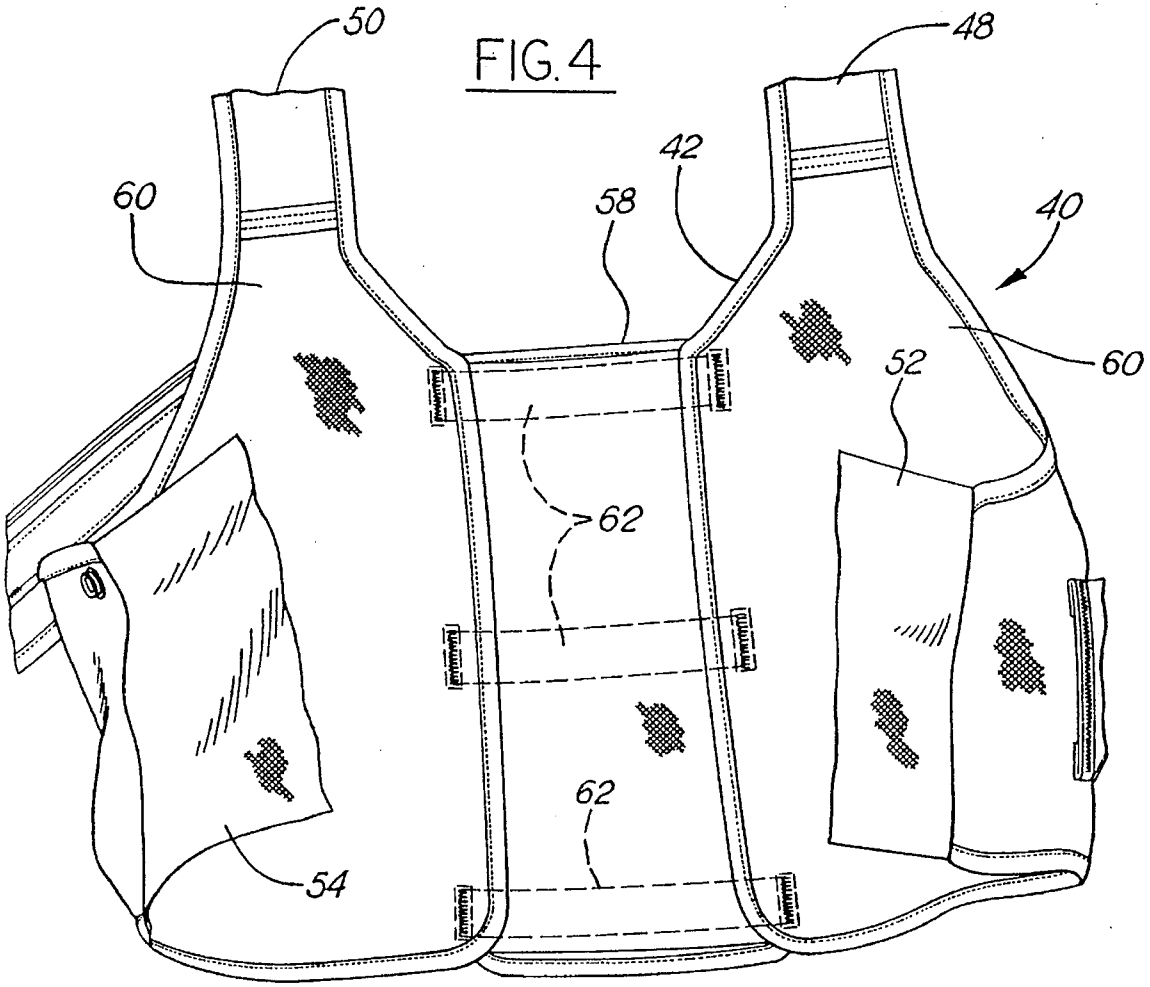
FIG. 4 is a cutaway view of an inside of the vest front.

Three horizontal elastic support straps 62 shown in FIG. 4 connected on opposite ends to right front panel 42 and left front panel 44 support front center floating panel 58. Strips of nylon cloth webbing are sewn to an interior side of floating panel 58 to define channels 64 in which elastic straps 62 are disposed. The floating panel 58 is so named because it is suspended, or floats, between right front panel 42 and left front panel 44 on elastic straps 62 enabling front center panel 56 to expand unrestricted.

A front side of floating panel 58, best shown in FIG. 1, includes a handcuff pouch 66 sewn to the upper center portion of floating panel 58, and has a pouch flap 68. The handcuff pouch 66 and pouch flap 68 are both lined with a tightly woven blastic resistant fabric (not shown) and a layer of foam padding between the liner and the outside of pouch 66 to protect the handcuffs. Pouch flap 68 is provided with a flap pull 70 to facilitate release of a snap closure (not shown).

Figure 9:
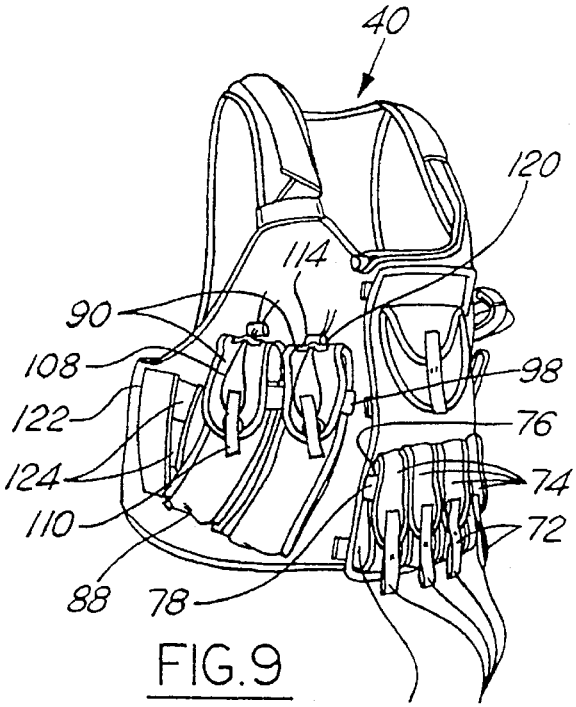
FIG. 9 is a perspective view of the load bearing vest of FIG. 8 without the auxilliary pouches shown in FIG. 8.

Four small arms pouches 72, best shown in FIG. 9 and FIG. 1, accommodate ammunition clips for a Colt 45 pistol or an M-9 9mm Beretta pistol and are provided on a lower portion of floating panel 58. Each pouch 72 and its associated flap 74 are defined by a single strip of the same material used for the front and rear panels. The strip is folded over on itself with a first edge defining an upper edge 76 of pouch 72 and a second edge defining a lower end of flap 74. The pouch 72 is open on its sides.

An elastic retention strap 78, approximately 1 inch wide, at upper edge 76 of pouch 72 retains upper edge 76 relative to floating panel 58. A pouch lining 80 of ballistic resistant material is disposed on an inside of pouch 72 and flap 74. A 1 inch wide strap of webbing (not shown) fixed to a front of pouch 72 retains elastic strap 78 relative to pouch 72. A backside of pouch 72 is fixed to floating panel 58 by stitching along both sides at the upper ends and lower ends of the pouch 72. A flap pull 86 and an associated snap closure (not shown) are disposed on pouch 72 to enable securing flap 74 to pouch 72, and to enable easy release of the snap closure.

Figure 13:
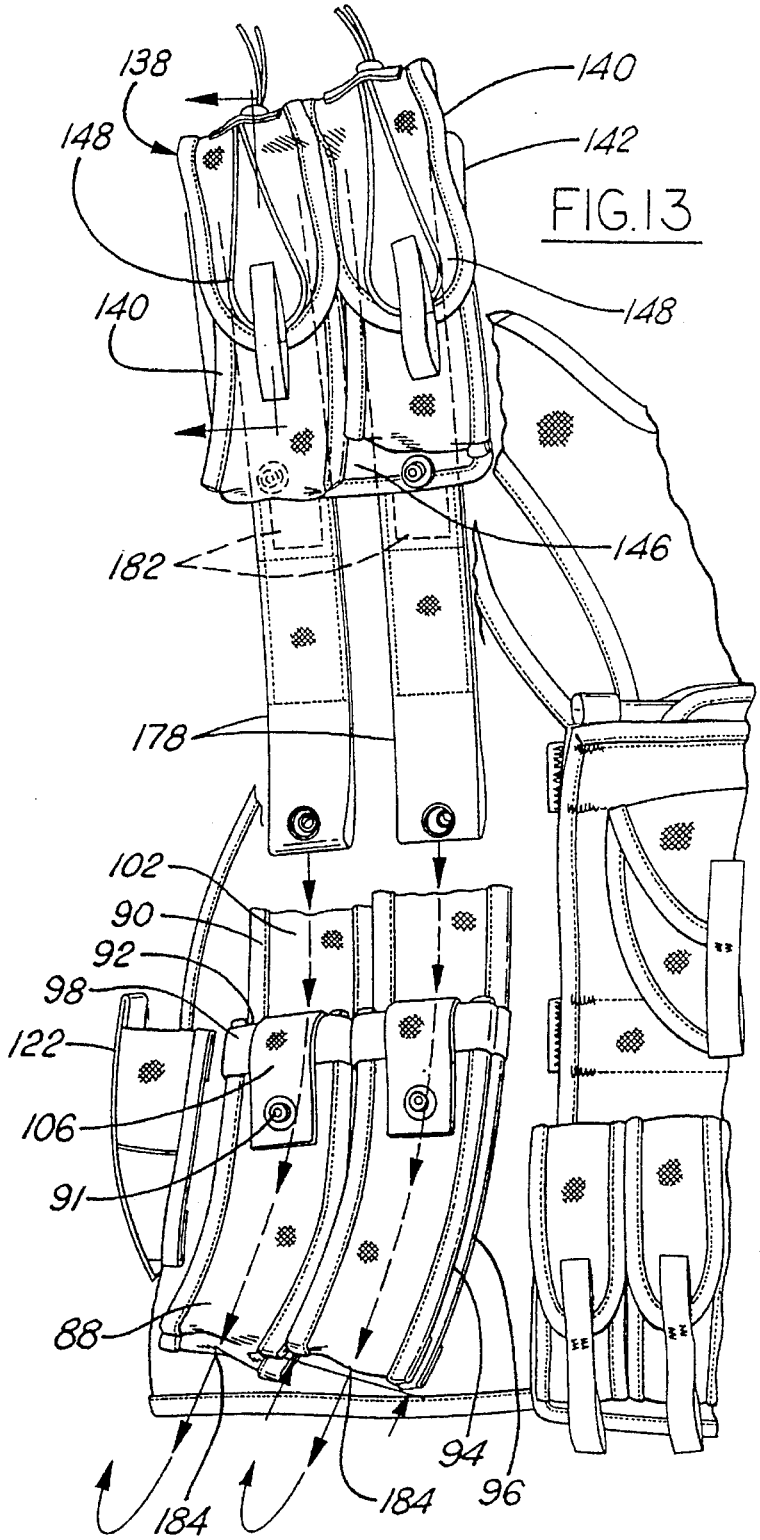
FIG. 13 shows the auxilliary pouch assembly positioned for mounting to the vest.

Four MP5 pouches 88 for retaining MP5, ammunition magazines and best shown in FIG. 9 and FIG. 13, are disposed on the front of the vest, with two on each of the right front panel 42 and left front panel 44. The pouch 88 and an associated pouch flap 90, like the small arms pouch 72 and flap 74, are essentially formed from a single strip of material. Pouch 88 and flap 90 are slightly curved to compliment the shape of the ammunition magazine received. A snap closure 91 is disposed between a lower end of flap 90 and an upper edge 92 of pouch 88. Pouch 88 is closed on its left and right side by small panels of the Power Mesh material. Vertical seams 94 fix pouches 88 to both the right and left front panels 42, 44. An elastic retention strap 98 is disposed across upper edge 92 and helps to reinforce pouch side at their upper edges. Pouch 88 uses the ballistic resistant material as a liner 102. A retaining loop 106 of nylon webbing proximate to upper edge 92 traps elastic strap 98.

A 3/16" bungee cord is used as a pouch flap drawstring 108. A flap pull 110 disposed on flap 90 defines an inner loop (not shown) and covers a top portion of snap closure 91. Drawstring 108 is sewn to a bottom edge of flap 90 and crisscrosses within the inner loop. Drawstring 108 passes upward through a second webbing loop 114 near a top of pouch flap 90 and then through a webbing tab (not shown) with a reinforcing eyelet at a top of pouch 88. A barrel clip 120 is disposed over an end of drawstring 108, and is used to adjust the free length, and therefore the tension of drawstring 108.

A side pouch 122, best shown in FIG. 1, is disposed rightward, or rearward, of MP5 pouches 88. Side pouch 122 is defined by a 5½ inch length double layer of 1⅜ inch wide nylon webbing sewn at a bottom edge to right front panel 42. Two adjacent pieces of 2" wide elastic material 124, sandwiched between the 2 layers of webbing and extend laterally therefrom are sewn to right front panel 42 and define sides of side pouch 122.

A holster 126, best shown in FIGS. 16, 17A, 17B, 18A and 18B, is fixed to left front panel 44 and can be configured to accommodate either a Colt 45 or a 9 mm Beretta pistol. A snap 128 is provided at muzzle end of the holster. The snap 128 can be engaged or disengaged to shift the position of the pistol to that best suited to the vest wearer. The holster has a pair of primary holster closure straps 130 and 131 with a snap closure 132 disposed therebetween. The outermost of the straps 131 includes a Velcro® type pile patch 133 affixed to an end thereof. A secondary closure strap 134 extending upward from an outer side of holster 126 has a Velcro® type hook patch 136 for engagement with the outermost closure strap having the pile patch 133. This secondary closure strap 134 helps prevent accidental release of the pistol from holster 126.

Figure 15C:
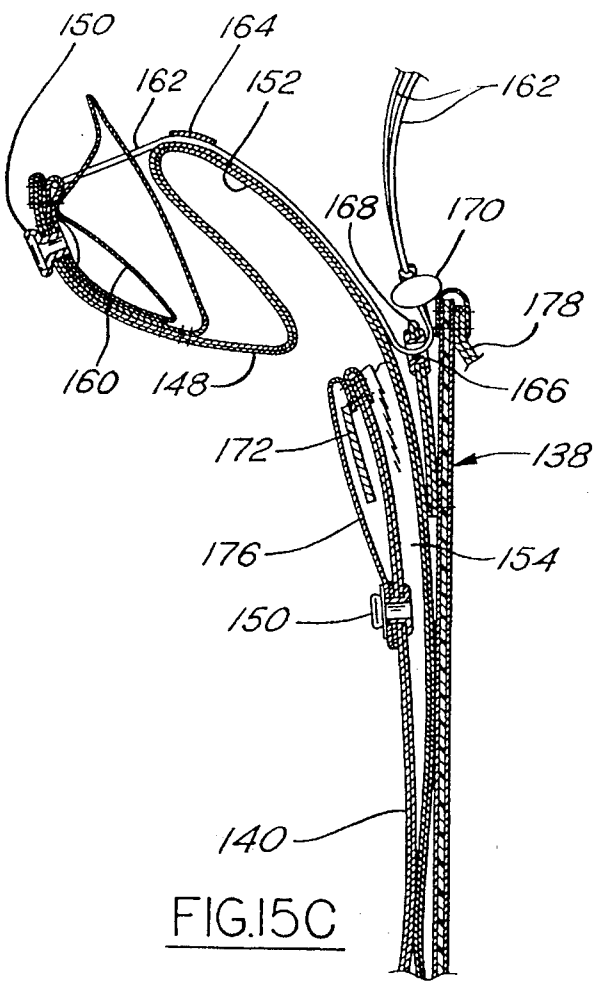
FIG. 15C is a sectional view of the auxilliary pouch of FIG. 15B with the elastic drawstring tensioned and the flap closure released.

A pair of auxilliary pouch assemblies 138, best shown in FIG. 1 and FIGS. 15 A, B, and C. FIGS. 10–13, one for right front panel 42 and one for left front panel 44, are located over the MP5 pouches 88. Each auxilliary pouch assembly 138 has two M16 pouches 140 configured to receive an M16 ammunition magazine.

Pouches 140 are fixed to a base portion 142. Base portion 142 has at its core a semirigid plastic reinforcement 144 over which is placed inner and outer layers of durable abrasion resistant woven nylon 146. Other than their respective dimensions, the M16 pouches 140 are essentially identical to the MP5 pouches 88. Pouches 140 have an associated pouch flap 148 and a snap closure 150. Pouch 140 and flap 148 are, like pouch 88 and flap 90, formed of a single strip of material. The strip of material is similarly sewn on its lateral sides to fix it to base portion 142. A pouch liner 152 covering an inside of pouch 140 is made of the ballistic resistant material. Stretchable Power Mesh material forms side panels 154 of pouch 146. A lower portion of side panel 154 is formed by folding up tabs of the material strips defining the pouch. A flap pull 158 formed of webbing is disposed over snap closure 150 and defines an inner loop 160.

A drawstring 162, best shown in FIGS. 15 A–C, is foraged of 3/16" bungee cord and sewn to a lower edge of flap 148. Drawstring 162 passes through a second webbing loop 164 near a top of flap 148, then passes through an eyelet 166 in a webbing tab 168 behind pouch 146. A spring loaded barrel clip 170 prevents drawstring 162 from pulling through eyelet 166, and enables adjustment of the drawstring free length and tension by pressing a release button on clip 170 and moving it along drawstring 162.

An elastic retention strap 172 passes across pouch 146 at an upper edge 174 thereof. Retention strap 172 is retained by a webbing loop 176 which also provides a reinforcement for the portion of snap closure 150 affixed to the pouch. Retention strap 172 is sewn, along with the lateral sides of strip material, to a base portion 142, and helps to reinforce side panels 154 at a top edge thereof.

Figure 11:
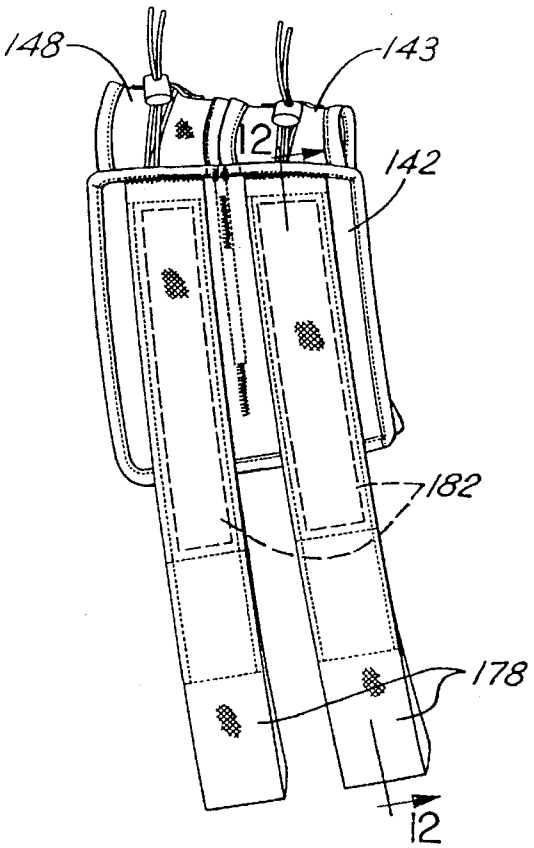
FIG. 11 is a rear view of the auxilliary pouch assembly.
Figure 12:
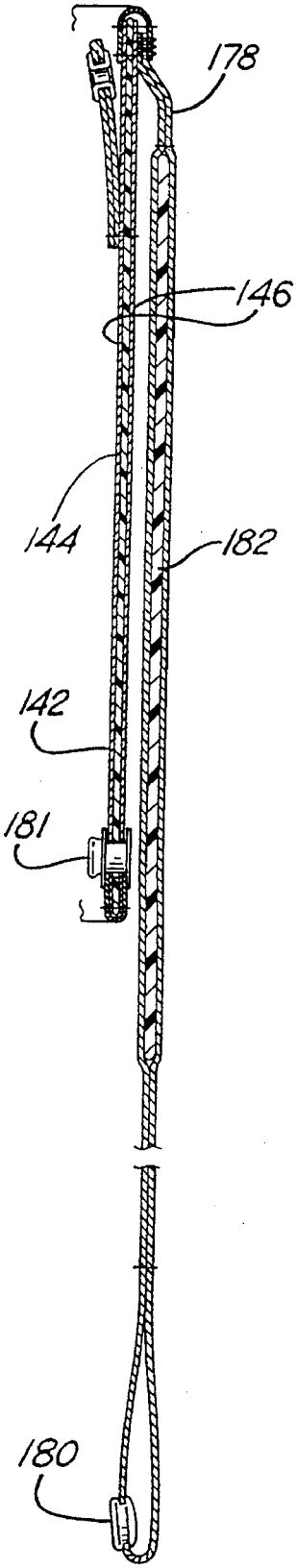
FIG. 12 is a sectional view of the auxilliary pouch in the direction of arrows 12 of FIG. 11.
Figure 14:
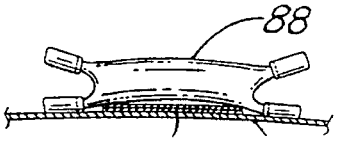
FIG. 14 shows an end view of a primary pouch permanently mounted to the right front panel in the direction of arrows 14 of FIG. 13 with a strap of the auxilliary pouches having been received by an opening or path underneath the primary pouch.

Two rear webbing straps 178, best shown in FIGS. 11 and 12, are fixed to a top edge of base portion 142. An outer portion 180 of a snap closure is disposed at an end of the strap for engagement with an inner portion 181 of the snap closure disposed at a bottom edge of base portion 142. Each of straps 178 include a reinforcement 182 formed of a piece of rigid plastic such as Lexan. Straps 178 pass, as shown in FIGS. 13 and 14, through strap passages 184 defined by MP5 pouches 88 and their lateral seams 94. Lexan reinforcements 182 making it possible to push straps 178 through passages 184.

Figure 19:
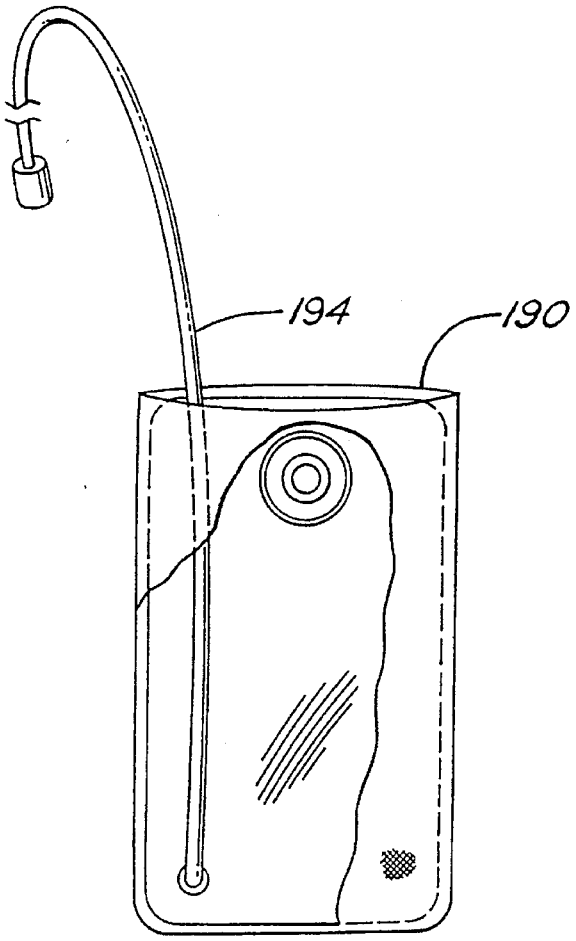
FIG. 19 is a rear view of a drinking bladder and drinking tube which are disposed in the vest.

A pleated pouch 186, best shown in FIGS. 2 and 3, made from the Power Mesh material is sewn to rear panel 46. Pleated pouch 186 has an overlapping closure 188 made of the same material which can be pushed upward to access the inside of the pouch. A water bladder 190, such as a Camelbak® bladder formed of vinyl, as shown in FIG. 19, is suitable. Bladder 190 is disposed in a foam backed nylon jacket (not shown) which provides thermal insulation and protects bladder 190. A drinking tube 194 extends upward from bladder 192 across left shoulder strap 50, and is covered by a protective cover 196 sewn to left shoulder strap 150. Drinking tube 194 extends beyond cover 196, with this portion being protected by a sleeve 198 as shown in FIG. 1. Sleeve 198 includes a loop of material which serves as a clipping tab or an attachment feature 202 for attachment to another portion of the vest or part of the wearer's uniform by an alligator clip or other suitable means for the purpose of positioning an end of drinking tube 198 proximate to the wearer's mouth.

Figure 20:
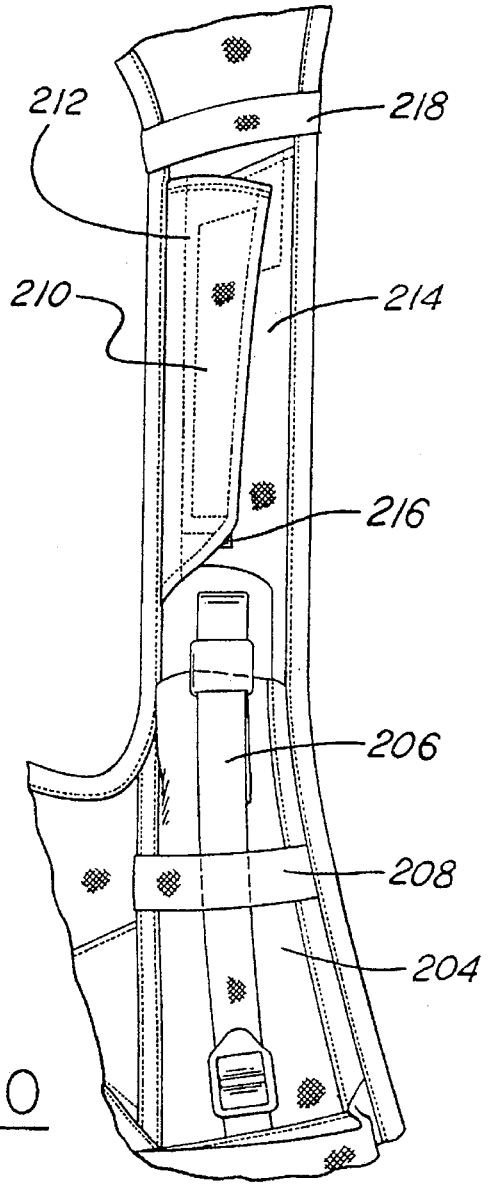
FIG. 20 is a broken out view of a portion of the vest of FIG. 2 and FIG. 3 showing a radio compartment.

A radio pouch, 204 best shown in FIG. 20 and also shown in FIGS. 2 and 3, is formed of Power Mesh and is fixed to the rear panel 46, extending toward right shoulder strap 148 to accommodate a two-way radio such as a Motorola MX3000. A radio retention strap 206 extends longitudinally across the radio pouch 204 to prevent the radio from becoming dislodged from the pouch. A radio stabilization strap 208 extends laterally across radio pouch 204 to prevent excess lateral movement of the radio. A microphone wire enclosure 210 includes a first flap 212 and a second flap 214 with a Velcro® type of closure 216. Covered by enclosure 210 are two retaining loops (not shown) used to keep the wire in position. A Lexan reinforced lateral strap 218 is at a forward end of right shoulder strap 48 to which a radio detent button can be secured.

A rescue pull strap 220 is disposed just above pleated pouch 186. Rescue pull strap 220 provides a convenient handle for a rescuer to pull a wearer of the vest to safety.

The invention is best appreciated if the utility of all of its features is completely understood.

Figure 7:
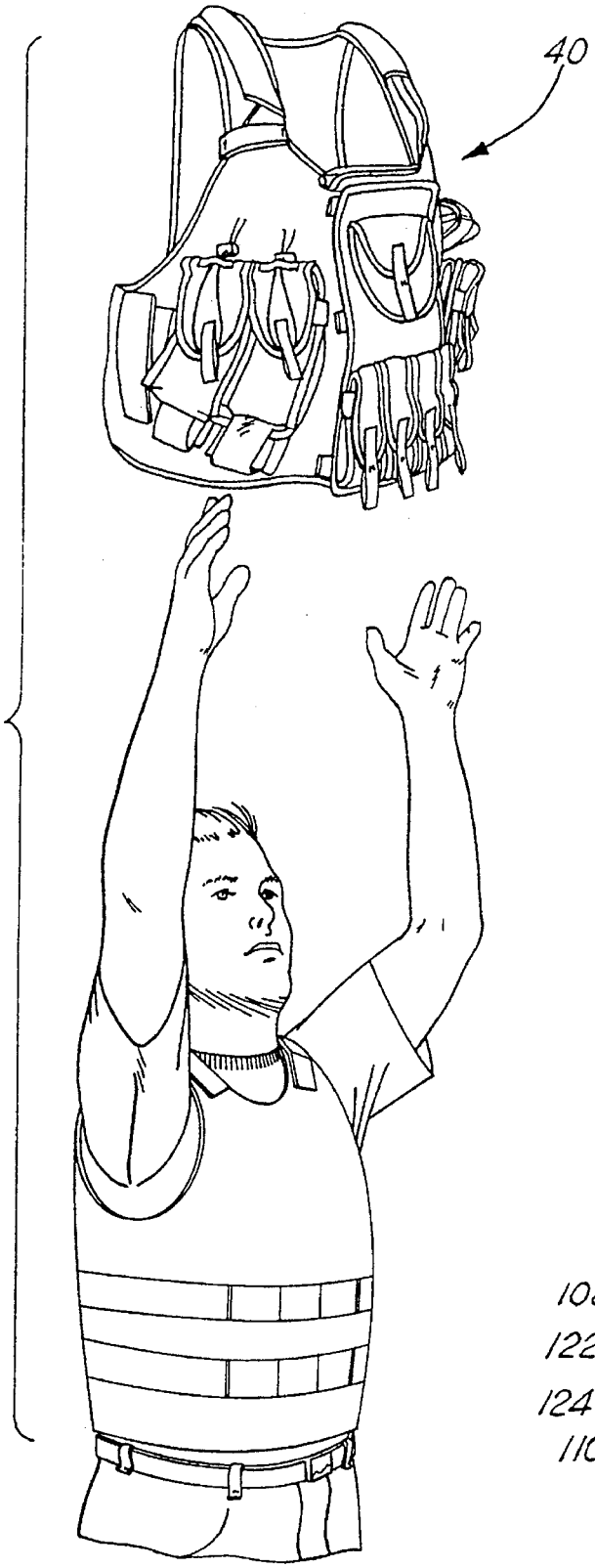
FIG. 7 is a perspective view of a person wearing a ballistics armor vest prepared to don the load bearing vest, with the vest positioned over him.
Figure 8:
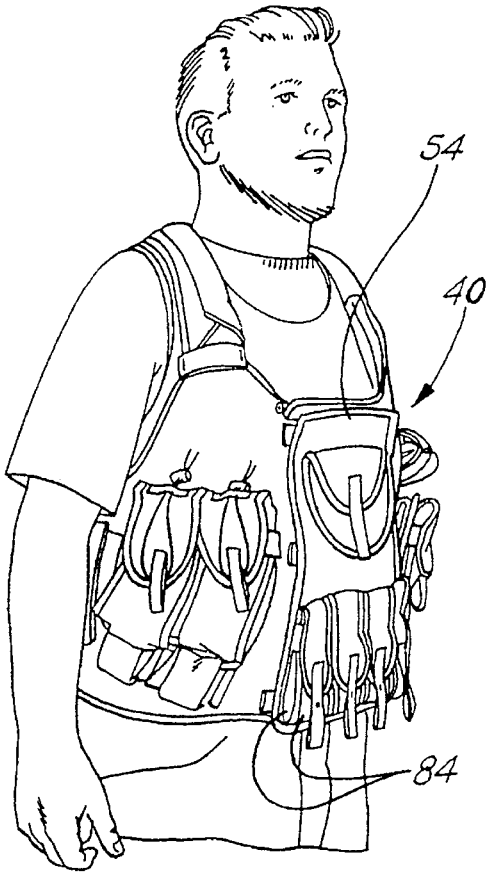
FIG. 8 is a perspective view of a person wearing the load bearing vest.
Figure 5:
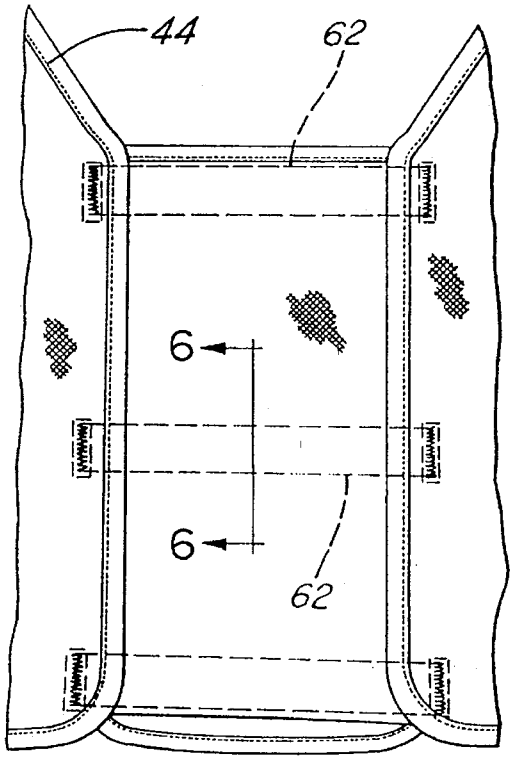
FIG. 5 is a broken out view of the center panel of FIG. 4 in a stretched condition.

Load bearing vest 40 is provided with three stretching or expandable panels, those being the right and left side panels 52 and 54, and front panel 56. When a person is donning the vest, as shown in FIG. 7, the expandable panels can be stretched as shown in FIGS. 3 and 5 to enable it to fit over the wearer and any bulky garments he may be wearing, such as any one of several types of personal body armor 220, without the need to use conventional fasteners such as Velcro® closures, snaps or laces. Of course, if so desired, vest 40 can be provided with a lace-up closure in any one of several spots, such as between the right side panel and the right front panel 42 to provide additional adjustment. Once the vest 40 has been placed on the wearer, it should fit fairly snugly against the underlying garment.

The suspension of floating panel 58 on the three horizontal elastic support straps 62 enables front center panel 56 to expand to better fit the wearer without significantly affecting the position of floating panel 58.

Figure 15B:
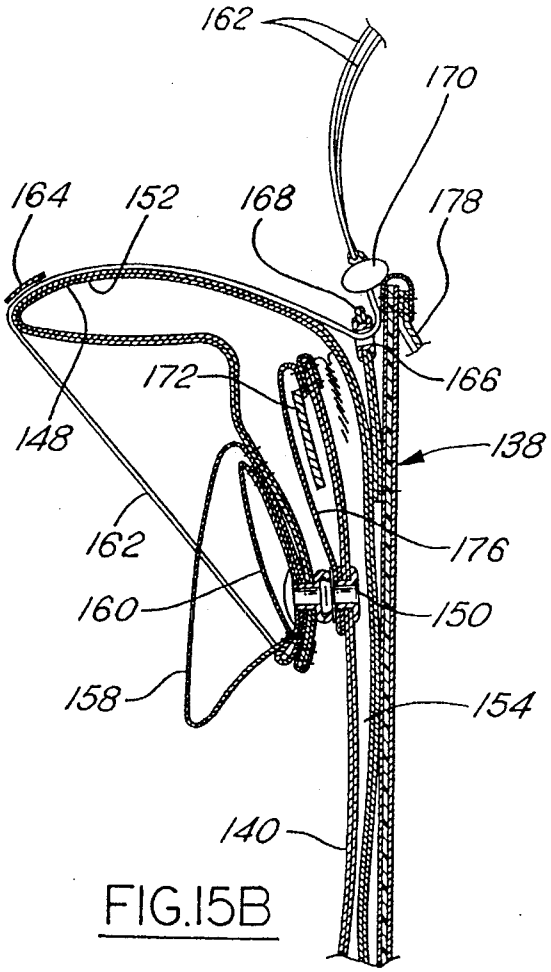
FIG. 15B is the sectional view of the pouch of FIG. 15A, with the elastic drawstring in a tensioned position, and the flap closure engaged.
Figure 15A:
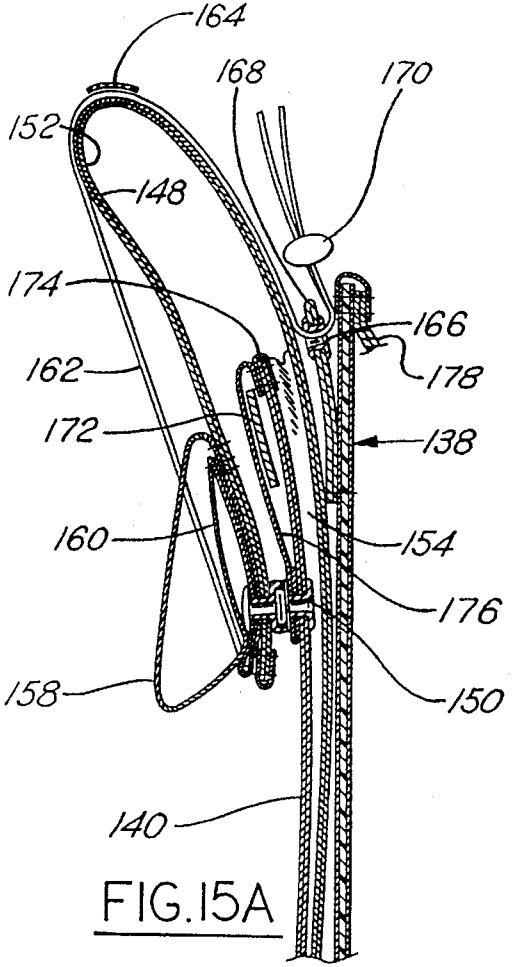
FIG. 15A is a sectional view through an auxilliary pouch of the pouch assembly in the direction of arrows 15 of FIG. 13, with an elastic drawstring over the flap in a relaxed position.

Providing pouch flaps 90 and 148 with elastic drawstrings 108 and 162 facilitates their opening. Although FIGS. 15A, 15B, 15C do not show an ammunition magazine in pouch, approximately one-third of the magazine would extend beyond the upper edge of the pouch. To tension the drawstring, the magazine is placed in pouch 140. A free end of drawstring 162 is pulled on while depressing the release button on barrel clip 170. FIG. 15B shows a pouch flap bent over by the tensioned drawstring 162. However, flap 148 is maintained in an upright position, as shown in 15A even when the drawstring is tensioned by the magazine. When snap closure 150 is released, flap 148 is drawn upward, clear of the magazine by drawstring 162. With the elastic drawstring pulling the flap out of the way, the magazine in the pouch will be easily accessed by a wearer of the vest. Auxilliary pouch assembly 138 is easily discarded to access MP5 pouches 88 by quickly undoing snap closures 180, pulling upward on assembly 138 to withdraw straps 178 from passage 184. The reinforcement 182 in strap 178 facilitates its reinsertion through passage 184.

A preferred embodiment has been disclosed. However, a person skilled in the art would readily appreciate that certain modifications of the disclosed embodiment would come within the teachings of this invention. The following claims should be studied in order to determine the true scope of the invention.

I claim:

1. A load bearing vest for military and police usage comprising:

a right front panel formed of durable abrasion resistant material:

a left front panel formed of durable abrasion resistant material:

a rear panel formed of durable abrasion resistant material;

a right shoulder strap formed of durable abrasion resistant material connecting an upper portion of the right front panel with an upper portion of the rear panel:

a left shoulder strap formed of durable, abrasion resistant material connecting an upper portion of the left front panel with the upper portion of the rear panel:

an expandable right side panel form of elastic material with a high strain capacity connecting the right from panel with the rear panel below the shoulder strap defining a right arm opening therebetween and extending downward from the opening:

an expandable left side panel formed of elastic material with a high strain capacity connecting the left front panel with the rear panel below the left shoulder strap defining a left arm opening therebetween and extending downward from the left arm opening;

an expandable front closure connecting the right front panel with the left front panel;

a floating front center panel connected to the front closure wherein the front closure is elastically expandable independent of the floating panel.

2. A load bearing vest for military and police usage as claimed in claim 1 wherein a front center expanding panel formed of elastic material with a high strain capacity is fixed to the right front panel and the left front panel behind the front closure opposite the floating front center panel.

3. A load bearing vest for military and police usage as claimed in claim 1 wherein the panels all are provided with a mesh material interior lining resistant to slipping relative to personal armor types of garments.

4. A load bearing vest for military and police usage as claimed in claim 1 wherein a pouch is disposed on one of the front panels, the pouch having a flap and a flap closure, the flap biased upwards by an elastic cord fixed to a lower edge of the flap, and the cord being also substantially fixed relative to one of the flap and the front panel at a point superior to the lower edge of the flap wherein the elastic cord strained when the flap closure is engaged and the bias is insufficient to unseat the closure but does displace an end of the flap upward when the closure is released, and thereby facilities access to the open side of the pouch.

5. A load bearing vest for military and police usage as claimed in claim 4 wherein the pouch has a ballistic lining.

6. A load bearing vest for military and police usage as claimed in claim 1 wherein a pouch is disposed over the rear panel, the pouch being sized to accommodate a bladder for retaining drinking fluid, the bladder disposed in the pouch, and a drinking tube extending from the bladder along one of the shoulder straps to a front of the vest.

7. A load bearing vest for military and police usage as claimed in claim 6 wherein a protect sleeve is disposed over a portion of the drinking tube extending beyond the one of the shoulder straps.

8. A load bearing vest for military and police usage as claimed in claim 7 wherein an end of the sleeve opposite the one of the shoulder straps has an attachment feature wherein the attachment feature is used to maintain an end of the drnking tube proximate to a wearer's mouth.

* * * * *